US007931283B2

(12) United States Patent
Wegener

(10) Patent No.: US 7,931,283 B2
(45) Date of Patent: Apr. 26, 2011

(54) FRAME ASSEMBLY FOR IN-LINE SKATE

(75) Inventor: Andreas C. Wegener, Encinitas, CA (US)

(73) Assignee: Sunshine Distribution, Inc., Vista, CA (US)

( * ) Notice: Subject to any disclaimer, the term of this patent is extended or adjusted under 35 U.S.C. 154(b) by 649 days.

(21) Appl. No.: 11/781,745

(22) Filed: Jul. 23, 2007

(65) Prior Publication Data

US 2009/0026720 A1 Jan. 29, 2009

(51) Int. Cl.
*A63C 17/06* (2006.01)

(52) U.S. Cl. ..... 280/11.223; 280/11.27; 280/809

(58) Field of Classification Search ..... 280/11.27, 280/11.221, 11.231, 11.233, 11.19, 11.28, 280/809, 811
See application file for complete search history.

(56) References Cited

U.S. PATENT DOCUMENTS

| | | | | |
|---|---|---|---|---|
| 250,319 | A * | 11/1881 | Yates | 280/7.13 |
| 4,214,768 | A | 7/1980 | Dominy et al. | |
| 4,273,345 | A | 6/1981 | Ben-Dor et al. | |
| 4,323,259 | A | 4/1982 | Boudreau | |
| 4,928,982 | A | 5/1990 | Logan | |
| 5,183,276 | A | 2/1993 | Pratt | |
| 5,234,230 | A | 8/1993 | Crane et al. | |
| 5,327,329 | A | 7/1994 | Stiles | |
| 5,411,278 | A | 5/1995 | Wittmann | |
| 5,456,478 | A | 10/1995 | Hsu et al. | |
| 5,533,740 | A * | 7/1996 | Lin | 280/11.223 |
| 5,566,958 | A | 10/1996 | Sinelnikov et al. | |
| 5,630,624 | A | 5/1997 | Goodman | |
| 5,772,220 | A | 6/1998 | Gaster | |
| 5,806,860 | A | 9/1998 | Conte | |
| 5,836,591 | A | 11/1998 | Roderick et al. | |
| 5,934,693 | A * | 8/1999 | Nicoletti | 280/11.231 |
| 5,967,552 | A | 10/1999 | Roderick et al. | |
| 6,006,450 | A | 12/1999 | Hayes | |
| 6,029,983 | A | 2/2000 | Wegener | |
| 6,041,525 | A | 3/2000 | Kelley | |
| 6,070,886 | A | 6/2000 | Cornelius et al. | |
| 6,089,580 | A | 7/2000 | Borel et al. | |
| 6,105,978 | A | 8/2000 | Vuerchoz | |
| 6,142,489 | A | 11/2000 | Borel | |
| 6,247,251 | B1 | 6/2001 | James | |
| 6,416,081 | B1 | 7/2002 | Goodman | |
| 6,581,943 | B2 | 6/2003 | Wegener | |
| 6,863,284 | B2 | 3/2005 | Wegener | |
| 6,902,173 | B2 * | 6/2005 | Borel et al. | 280/11.233 |
| 7,357,420 | B2 * | 4/2008 | Hyser | 280/825 |
| 7,594,666 | B2 * | 9/2009 | Wegener | 280/11.15 |
| 2003/0227144 | A1 * | 12/2003 | Johnson | 280/11.233 |

* cited by examiner

*Primary Examiner* — J. Allen Shriver, II
*Assistant Examiner* — Bridget Avery
(74) *Attorney, Agent, or Firm* — Procopio, Cory, Hargreaves & Savitch LLP

(57) ABSTRACT

An in-line skate frame assembly has a rigid frame and an elongate grinding insert releasably engaged with the frame. The frame and insert are secured together to the sole of a shoe or boot by frame bolts extending through upper portions of the frame and insert. The frame has spaced side walls with downwardly facing recessed regions in which the insert is mounted. The insert extends along a major portion of the length of the frame and has a downwardly facing, centrally located grinding surface which terminates short of the opposite ends of the insert. Different inserts with grinding surfaces of different shapes and lengths are releasably secured to the frame for performing alternative grinding maneuvers.

29 Claims, 9 Drawing Sheets

FRAME ASSEMBLY FOR IN-LINE SKATE

BACKGROUND

1. Field of the Invention

The present invention relates generally in-line skates and is particularly concerned with an in-line skate frame with a H-block or grinding insert.

2. Related Art

In-line skates typically have a series of wheels arranged one after the other in a single row or line in the running direction. The wheels are rotatably mounted on a frame, and the frame is connected to the sole of a shoe or skate boot, or may be integrated into the sole of the boot. The frame typically has a pair of side plates between which the wheels are mounted, and an upper portion with openings through which a frame bolt extends to attach the frame to the sole of a boot.

In some skates, particularly so-called extreme, aggressive, or stunt skates, the center of the lower edge of each plate is arched to provide a sliding surface for the skater to slide or grind along a railing, curbstone edge, or the like. This results in wear and eventually requires replacement of the entire frame. In some cases, a so-called "H-block" of different material is secured in a downwardly directed recess at the center of the frame, between two of the wheels, and has an arched, downwardly facing sliding surface. The H-block can be made of various different materials in order to provide faster or slower sliding surfaces. This avoids or reduces the risk of damage or abrasion to the frame itself during sliding or grinding. The H-block insert can be removed and replaced as necessary. A H-block insert device is described in my U.S. Pat. No. 6,581,943. The purpose of H-blocks is to provide an inexpensive solution to replace the part of the frame that wears down the most during stunts such as grinding.

One problem with some existing H-block insert designs is that the structure of the frame may be weakened by the cut-out or recess which is provided to accommodate mounting of the H-block insert and attachment of the insert to the frame. This cut-out makes the frame less stiff, so that it is more likely to bend and eventually crack. The pressure on the outside wheels on landing after a jump bends the frame and may eventually cause the frame to crack.

SUMMARY

Embodiments described herein provide a new frame assembly for an in-line skate which has a removable H-block insert.

According to one aspect, an in-line skate frame assembly is provided, which comprises a rigid frame, the frame having an upper portion and a pair of spaced side walls extending downwardly from the upper portion, the side walls having at least two pairs of aligned wheel axle openings which rotatably receive a pair of in-line skate wheels between the side walls, the upper portion of the frame having at least two spaced fastener openings, the side walls shaped to define a recessed region, and an elongate H-block insert engaging in the recessed region and extending between the side walls, the H-block insert having spaced side walls each having an outer face which is substantially flush with the outer faces of the frame side walls, a lower, arcuate grinding surface, and an upper portion between the side walls which has openings aligned with the respective fastener openings in the upper portion of the frame, the fastener openings and aligned openings in the H-block insert receiving fasteners which secure the H-block insert and frame together.

In one embodiment, the frame is formed separately from the skate boot and the insert is secured to the frame by frame bolts which in turn secure the frame to the sole of the boot. There may be three spaced fastener openings in the upper portion of the frame aligned with corresponding fastener openings in the upper portion of the insert. In an alternative embodiment, the frame may be formed integrally with the sole of the boot.

In one embodiment, the wheel axle openings are located adjacent a front and rear end, respectively, of the frame, and a second pair of aligned wheel axle openings are provided in the H-block insert on opposite sides of the grinding surface for rotatably receiving a second pair of in-line skate wheels. In an alternative embodiment, only front and rear in-line skate wheels are mounted in the frame, and the grinding surface extends over an extended region between the front and rear wheels to provide for a greater range of grinding and sliding maneuvers.

The H-block insert of one embodiment has a pair of upwardly facing side channels which engage over recessed portions of the frame side walls to seat the respective insert side walls in the recessed regions of the frame side walls. The upper portion of the frame and of the insert may comprise a continuous platform, or may comprise spaced web or connecting portions extending between the upper ends of the side walls, with the fastener openings located in the respective web portions.

According to another aspect, an in-line roller skate is provided, which comprises a boot having a sole, a rigid frame having an upper portion which is attached by spaced fasteners to the sole of the boot and two spaced side walls or rails extending downwardly from opposite sides of the upper portion, each side wall having a recessed region of predetermined shape extending along a major portion of the length of the frame, at least a front wheel and a rear wheel secured between the side walls adjacent the front and rear end of the frame and spaced to the front and rear, respectively, of the recessed regions, and an elongate H-block insert having an upper portion attached to the rigid frame upper portion by the same fasteners which secure the frame to the sole of the boot, and spaced side walls extending downwardly from the upper portion.

In one embodiment, the H-block insert has a central, downwardly facing arcuate grinding surface, and third and fourth wheels are secured between the spaced side walls of the H-block insert, the third wheel being located in a space between the grinding surface and the front wheel, and the fourth wheel being located in a space between the grinding surface and rear wheel. In another embodiment, the skate has only a front wheel and a rear wheel, and the H-block insert extends along a major portion of the length of the frame and has a first end adjacent the front wheel and a second end adjacent the rear wheel, with an elongate grinding surface extending along a major portion of the length of the H-block insert and terminating short of the first and second ends of the insert. The grinding surface in this case may be generally V-shaped in longitudinal cross-section, with an apex and end portions which taper downwardly from the apex towards the opposite ends of the grinding surface. This alternative allows for more freestyle, acrobatic maneuvers using the extended grinding surface.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a frame assembly for an in-line skate which includes a removable H-block insert to provide a sliding or grinding surface.

After reading this description it will become apparent to one skilled in the art how to implement the invention in various alternative embodiments and alternative applications. However, although various embodiments of the present invention are described herein, it is understood that these embodiments are presented by way of example only, and not limitation. As such, this detailed description of various alternative embodiments should not be construed to limit the scope or breadth of the present invention as set forth in the appended claims.

Figure 1:
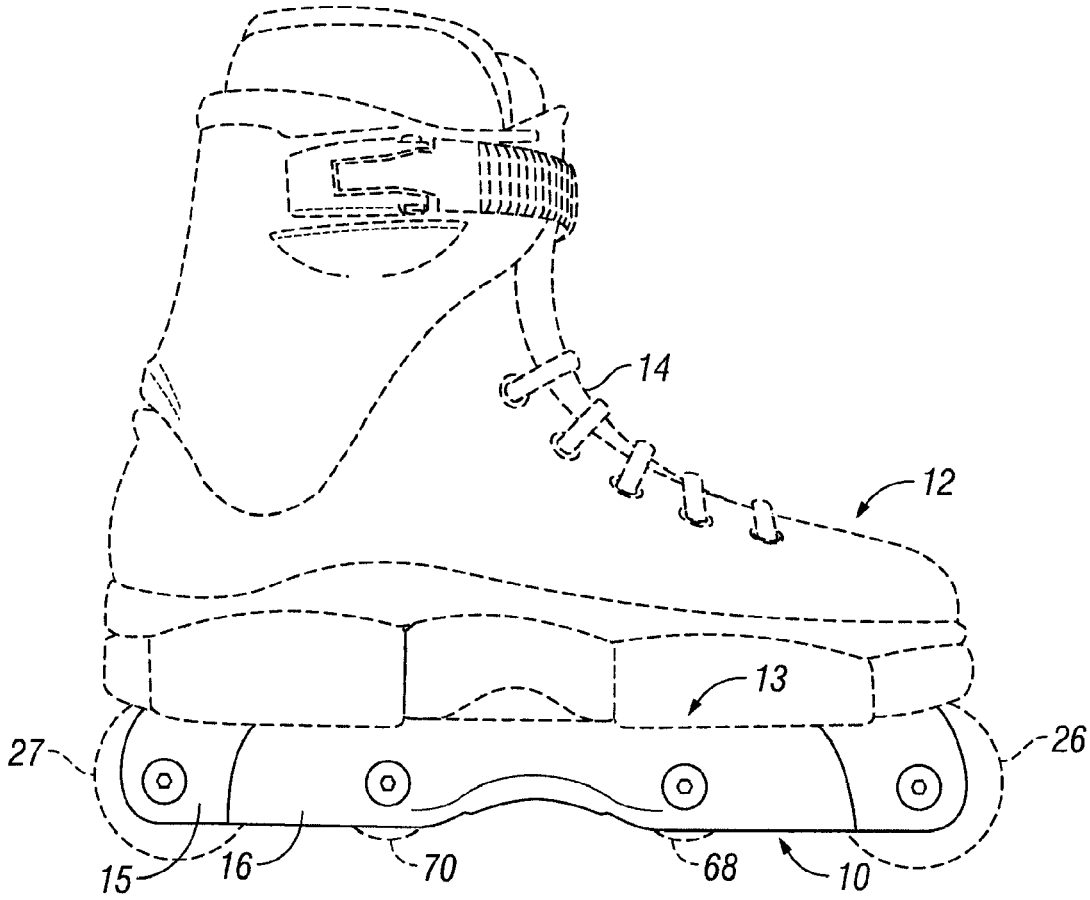
FIG. 1 is a side elevation view of an inline skate incorporating a frame assembly according to a first embodiment.
Figure 13:
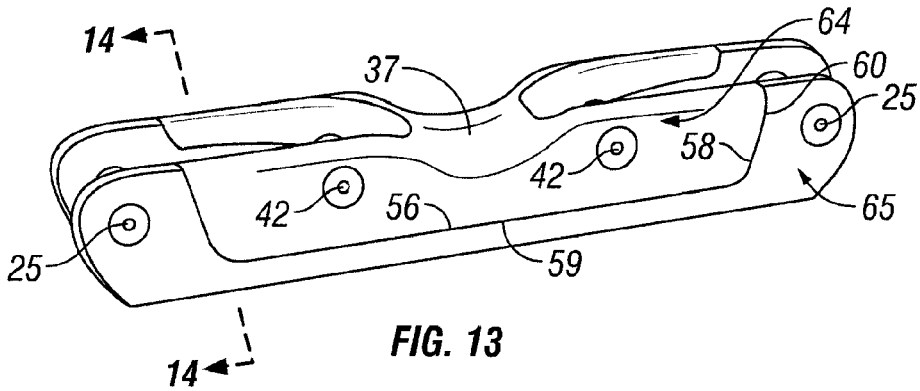
FIG. 13 is a bottom perspective view illustrating the assembled insert and frame member.
Figure 14:
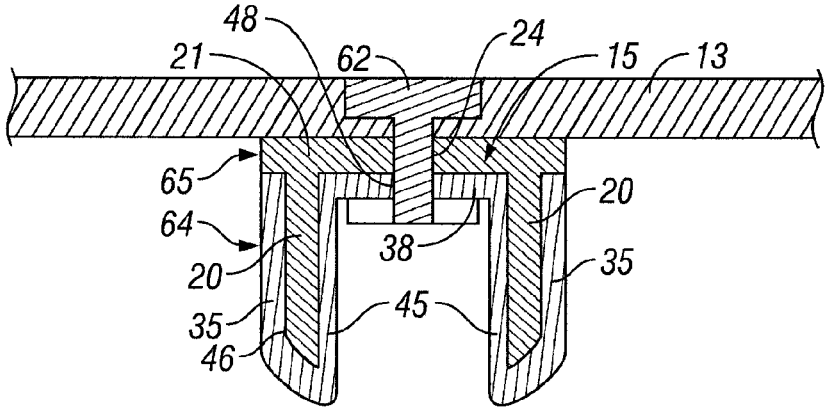
FIG. 14 is a cross-sectional view on the line 14-14 of FIG. 13 illustrating the frame assembly attached to the sole of a skate boot as in FIG. 1.
Figure 15:
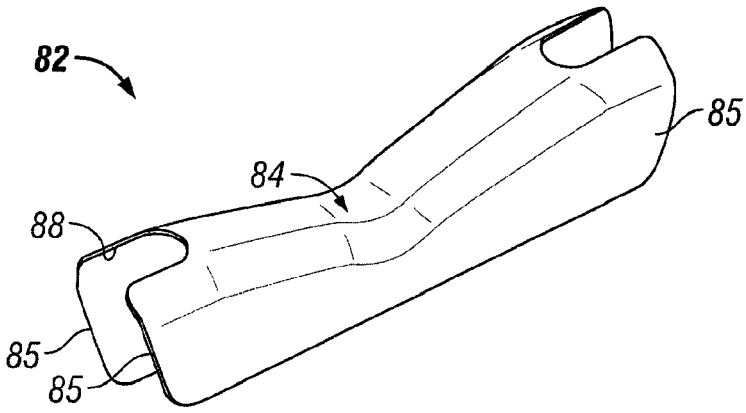
FIG. 15 is a bottom elevation view of a modified H-block insert of another embodiment of the frame assembly.
Figure 16:
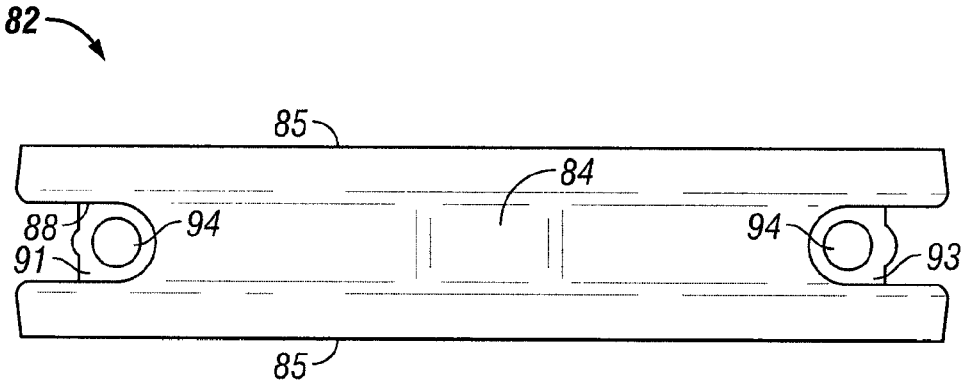
FIG. 16 is a bottom plan view of the insert of FIG. 15.

FIGS. 1 to 14 illustrate a first embodiment of a frame assembly 10 for an inline skate 12. FIG. 1 illustrates the frame assembly 10 attached to the sole 13 of an in-line skate boot 14, while FIGS. 2 to 12 illustrate the separate components of the frame assembly, and FIGS. 13 and 14 illustrate these components assembled together and ready for installation on a skate boot. The frame assembly comprises a rigid frame member 15 for attachment to the sole of a shoe or boot, and a H-block or grinding insert 16 secured in a shaped, downwardly facing recess 18 in the frame. The frame may be of any suitable rigid material such as metal or rigid plastic, and the H-block insert is of a rigid material which is relatively smooth to provide a sliding surface. In one embodiment, the H-block insert 16 is of rigid plastic material, but may be of other materials in alternative embodiments, such as composite materials, metal, or the like. The insert 16 is elongate and has a length greater than half the length of the frame.

Figure 2:
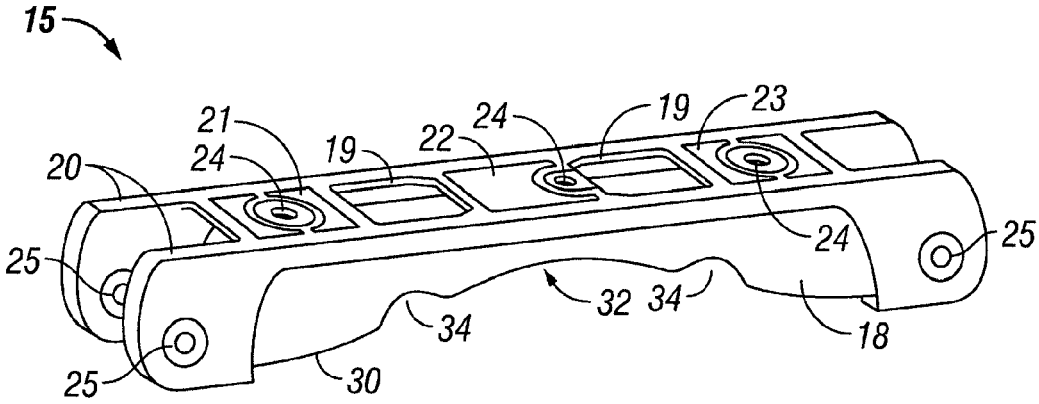
FIG. 2 is a top perspective view of the frame member of the frame assembly.
Figure 3:
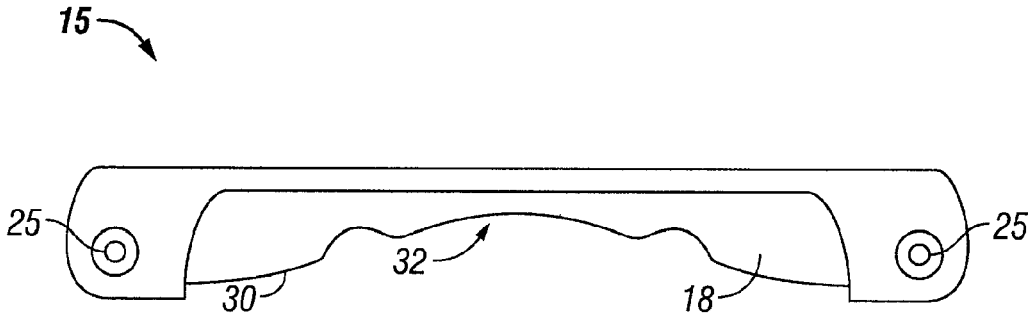
FIG. 3 is a side elevation view of the frame member.
Figure 4:
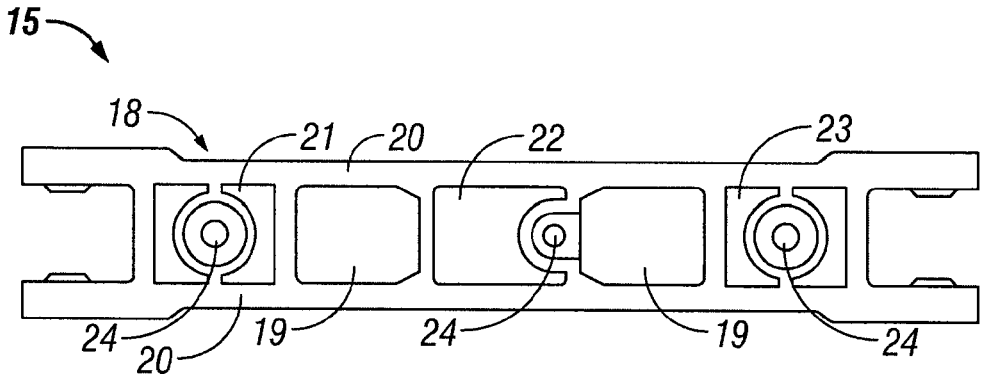
FIG. 4 is a top plan view of the frame member.
Figure 5:
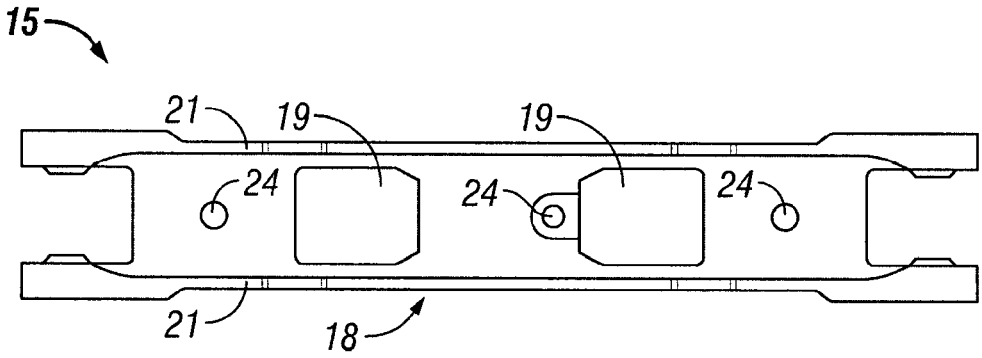
FIG. 5 is a bottom plan view of the frame member.
Figure 6:
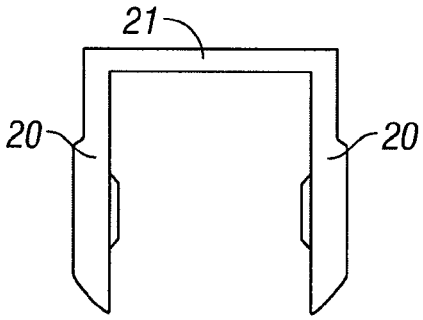
FIG. 6 is an end elevation view of the frame member.

FIGS. 2 to 6 illustrate one embodiment of the frame member 15 in more detail. In this embodiment, frame member 15 has a pair of spaced side walls 20 connected together at their upper, straight edges by a plurality of transverse webs or fastener platforms 21, 22, 23 separated by openings 19, as best seen in FIGS. 2 and 4. Each of the platforms or webs has a fastener opening 24. In the illustrated embodiment, the side walls are connected by three webs but a greater or lesser number may be provided in alternative embodiments, or a continuous platform or upper wall may connect the side walls. The advantage of spaced webs is that this reduces the amount of material required while still providing the necessary platforms for fastener connection to the boot. The side walls have two pairs of aligned wheel axle openings 25 adjacent the front and rear end of the frame, respectively, which rotatably receive wheel axles of a pair of front and rear in-line skate wheels 26, 27 between the side walls when assembled as illustrated in FIG. 1. Each side wall has an outwardly facing, inwardly recessed portion 18 of reduced thickness, as best illustrated in FIGS. 2 and 3, and the lower edge 30 of each recessed portion is upwardly curved from each end towards the center of the frame, to form an arch which has its highest point 32 at the center of the frame. Each lower edge also has two arcuate indents 34, one on each side of the highest point of the arch.

Figure 7:
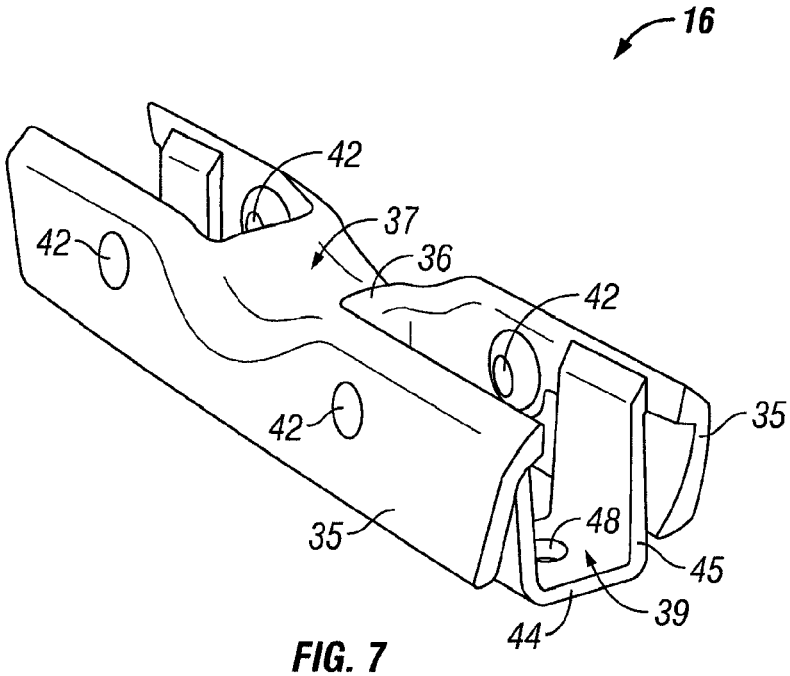
FIG. 7 is a bottom perspective view of the H-block insert of the frame assembly of FIG. 1.
Figure 8:
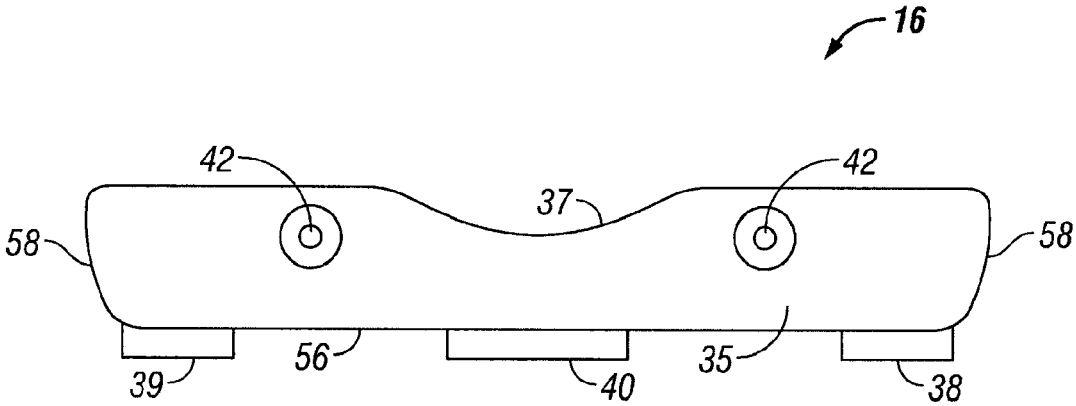
FIG. 8 is a side elevation view of the H-block insert.
Figure 11:
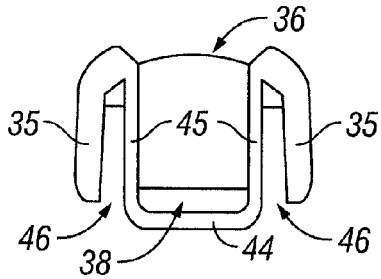
FIG. 11 is a front end elevation view of the H-block insert.

One embodiment of the H-block insert 16 is illustrated in more detail in FIGS. 7 to 11. In this embodiment, insert 16 has spaced side walls 35, a lower, arcuate grinding portion 36 extending between the side walls in a central region of the insert, and front, rear, and central connecting portions 38, 39, and 40 extending between the side walls. The grinding portion 36 has a smooth, arcuate downwardly facing grinding surface 37. The side walls 35 have two pairs of aligned wheel axle openings 42, one pair of openings located between the central connecting portion 40 and the front connecting portion, and the other pair of wheel openings located between the central connecting portion and the rear connecting portion 39. Each of the front and rear connecting portions is of square channel or U-shape, as illustrated in FIGS. 7 and 11, with an upper flat portion 44 and downwardly extending sides 45 which connect to the lower edges of the H-block side walls 35 at their lower ends, forming an upwardly facing groove 46 on each side. Each upper portion 44 has a fastener opening 48 at its center.

Figure 9:
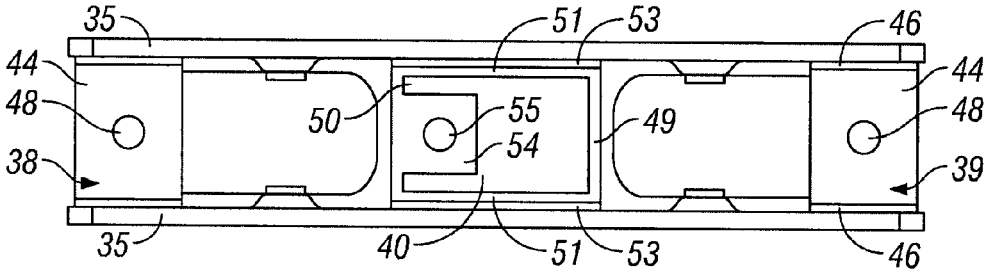
FIG. 9 is a top plan view of the H-block insert.
Figure 10:
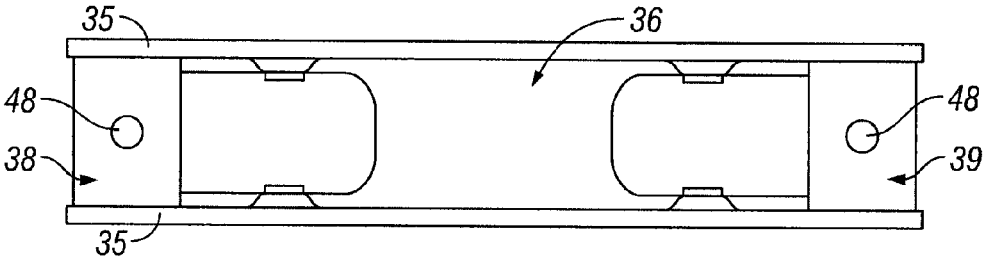
FIG. 10 is a bottom plan view of the H-block insert.

In one embodiment, the central connecting portion 40 is generally box-shaped and projects upwardly from an upper side of grinding portion 36, and has spaced front and rear end walls 49, 50 and spaced side walls 51 each spaced inwardly from the adjacent H-block side wall to form a recess or groove 53 aligned with grooves 46, as seen in FIG. 9. A block 54 on the inner face of front wall 48 has an upwardly facing bore 55 for receiving a fastener.

Figure 12:
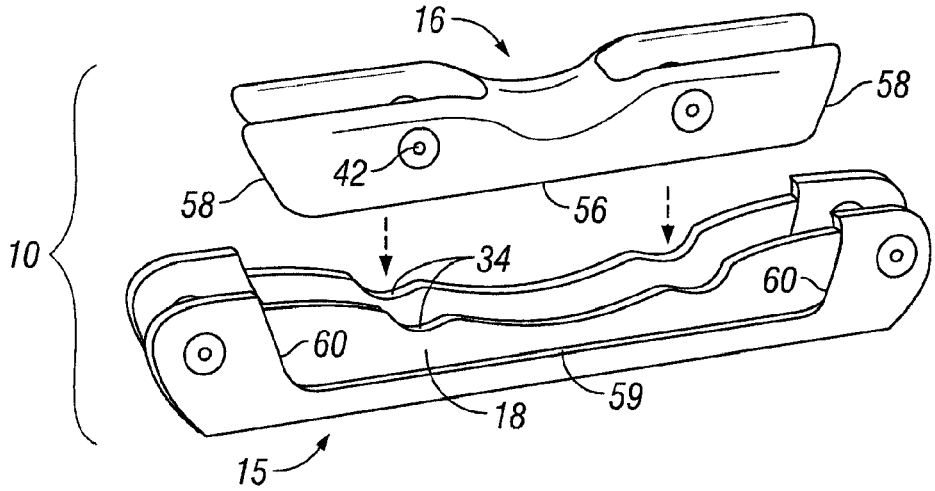
FIG. 12 is a bottom perspective view of the parts of the frame assembly of FIGS. 1 to 11 separated with the H-block insert positioned for engagement with the frame member.

The upper edge 56 and opposite end edges 58 of each side wall 35 are shaped to match the upper edge 60 and end edges 62 of the respective indented regions 18 of the frame side walls, as best illustrated in FIG. 12. The H-block insert 16 is engaged with the frame as illustrated in FIGS. 12 to 14, by engaging grooves 46, 53 on each side over the lower edge of the respective indented region 18 and pushing upwards until the side walls 35 are fully seated in the indented regions with the upper edges 56 abutting the upper edges 60 and the end edges 58 abutting the end edges 62 of the respective indented regions. This provides a tongue-and-groove engagement between each frame side wall and the corresponding H-block insert side wall.

The thickness of the H-block insert side walls is arranged such that, when the H-block insert is fully seated in the recessed region of the frame, the outer face 64 of each H-block side wall is flush or at least substantially flush with the outer side face 65 of the frame side wall surrounding the H-block, as illustrated in FIGS. 13 and 14. The arcuate recesses 34 in the lower edge of each indented region 28 engage over respective bosses surrounding the wheel axle openings 42 in the H-block frame as the parts are engaged together. The openings 48 in the front and rear connecting portions 38 of the H-block insert are designed to align with the corresponding openings 24 in the front and rear connecting webs 21, 23 of the frame, while the bore 55 in the central connecting portion is aligned with the fastener opening 24 in the central connecting web 22 of the frame.

The fastener openings 24 in the frame and aligned openings 48, 55 in the H-block insert receive fasteners or frame bolts 62 which secure the H-block insert and frame together to the sole 13 of the shoe or boot 14, as illustrated in FIG. 14. Thus, in one embodiment, the H-block insert is selectively secured to both the frame and the sole of the skate boot by the same fasteners or frame bolts 56 that secure the frame itself to the boot. This provides a relatively solid, strong, three-point attachment and may reduce the risk of weakening or bending of the frame where it engages the H-block. The two part assembly has a tongue-and-groove engagement between each side wall of the frame and the corresponding side wall of the H-block insert at three locations.

The length of the H-block is significantly increased in this arrangement. As seen in FIGS. 1 and 13, the length of the H-block insert is such that it extends up to a location close to the wheel axle openings 25 at the front and rear ends of the frame. As illustrated in FIG. 1, third and fourth in-line skate wheels or intermediate wheels 68, 70 are rotatably mounted between the spaced side walls of the H-block insert on wheel axles which extend through the aligned openings 42 in the side walls. The third wheel 68 is mounted in a space between the grinding surface 37 and the front wheel 26, and the fourth wheel 70 is mounted in a space between the grinding surface 37 and rear wheel 27.

The extended body of the H-block insert and the mounting of the insert over a recessed region of the frame side walls, as well as the three point attachment of the insert to the frame and skate boot with frame bolts provides a relatively strong structure which is more resistant to bending and potential cracking after jumps or other aerobatic maneuvers, for example. The H-block insert 16 can be replaced when the grinding surface becomes worn or if an insert with different sliding or grinding properties is desired, such as an insert of a different material or with grinding surface of a different shape, dimensions, or both.

Figure 18:
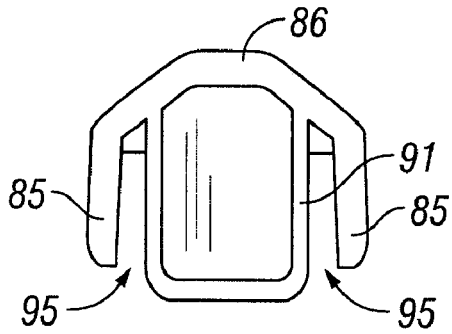
FIG. 18 is an end elevation view of the insert of FIGS. 15 to 17.
Figure 19:
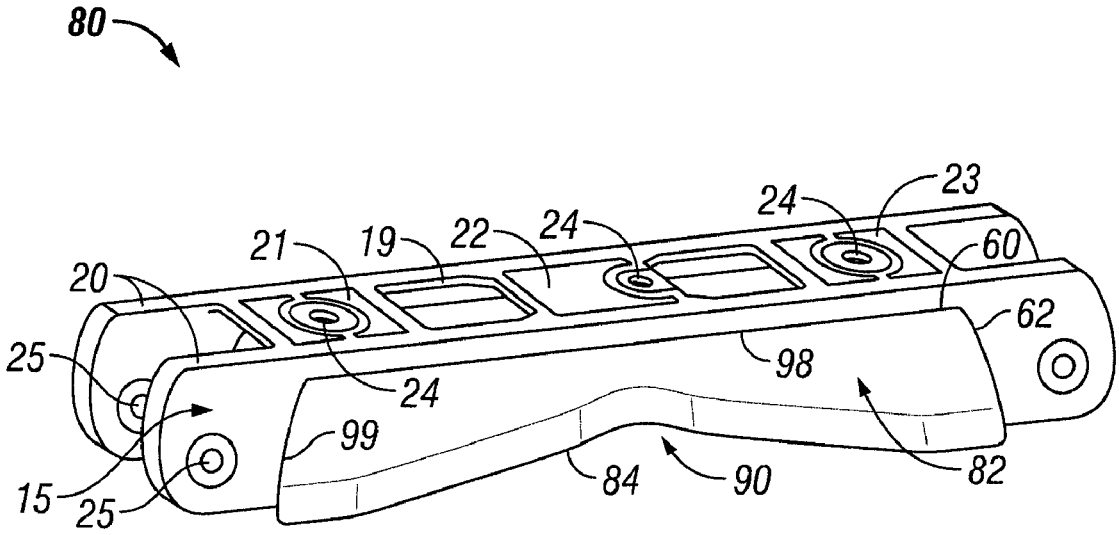
FIG. 19 is a top perspective view of the insert of FIGS. 15 to 18 assembled with the frame member of FIGS. 2 to 6 to form a modified frame assembly with an extended grinding surface.
Figure 20:
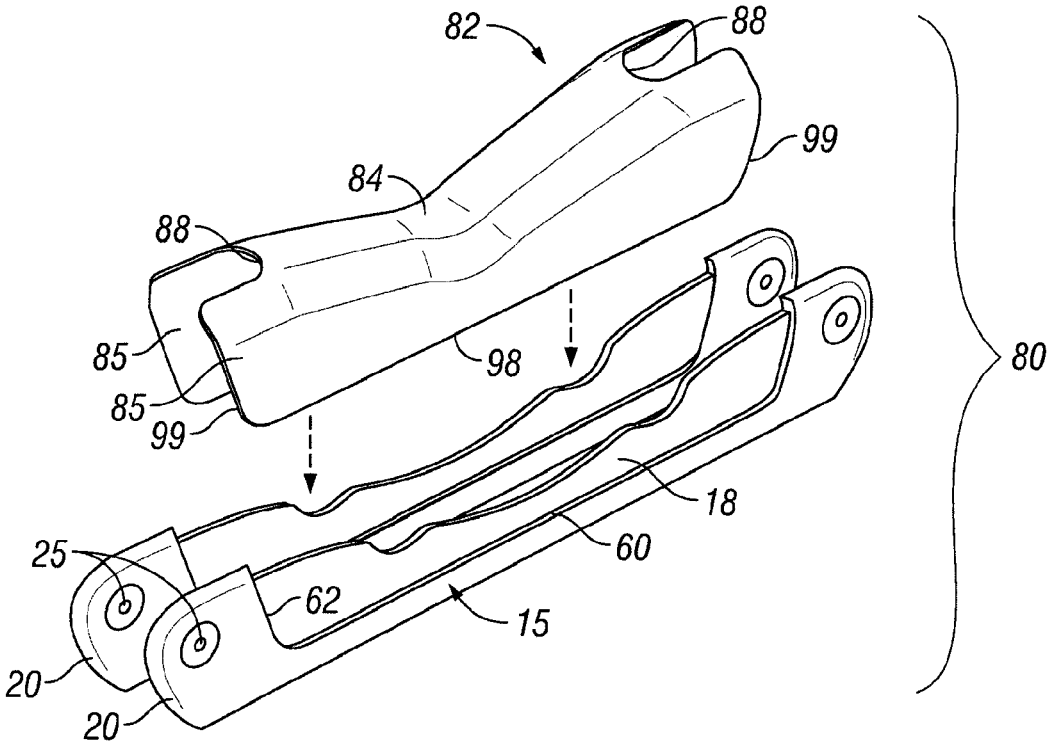
FIG. 20 is a bottom perspective view of the parts of the frame assembly of FIG. 19 separated from one another with the insert aligned for engagement in the recessed region of the frame member side walls.
Figure 21:
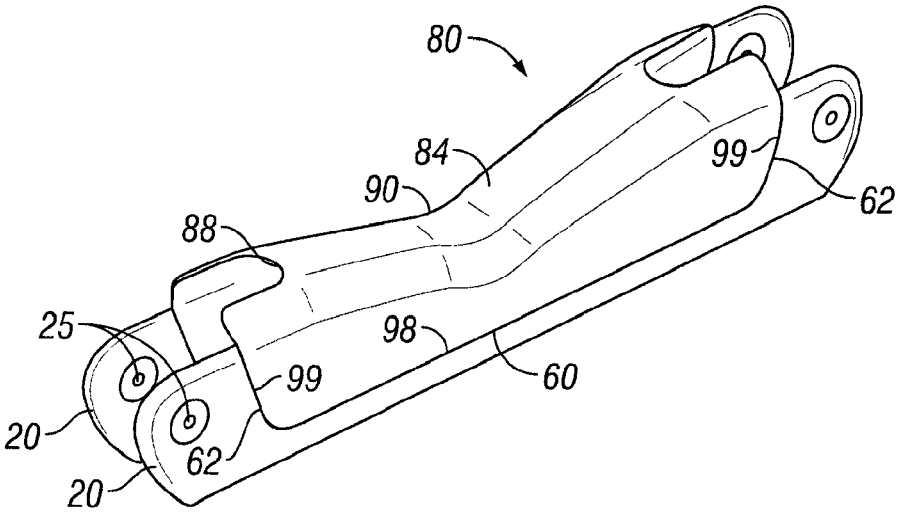
FIG. 21 is a bottom perspective view similar to FIG. 20 illustrating the parts assembled together.

FIGS. 19 to 21 illustrate a modified frame assembly 80 which comprises the frame member 15 of the previous embodiment and a modified H-block or grinding insert 82 which has an extended grinding surface 84. Frame member 15 in this embodiment is identical to the frame member of the previous embodiment, and like reference numerals have been used for like parts as appropriate. The grinding insert 82 is illustrated in more detail in FIGS. 15 to 18. In this embodiment, only two pairs of wheel axle openings 25 are provided at the front and rear end of the frame member 15, and the grinding insert 82 has no wheel axle openings. This embodiment is designed for acrobatic and grinding maneuvers on only two wheels, rather than conventional in-line skating on four aligned wheels. Frame assembly 80 is attached to a skate boot in the same way as illustrated in FIGS. 1 and 13 and described above in connection with the first embodiment, using three spaced frame bolts or fasteners.

As illustrated in FIGS. 15 to 18, grinding insert 82 has spaced side walls 85 connected together at their lower ends by grinding portion 86 which terminates short of the opposite ends of the insert 82 to provide generally U-shaped recesses 88 at each end for clearance over the front and rear wheels when the frame assembly is installed on a skate. The grinding surface 82 on the lower face of grinding portion 84 extends along a major portion of the length of the insert, and thus covers a major portion of the length of the installed frame assembly. As illustrated in FIGS. 19 to 21, the grinding surface 82 in side elevation is arched upwardly in an arcuate or shallow V-shaped configuration with the apex or highest point 90 at the center of the insert.

Figure 17:
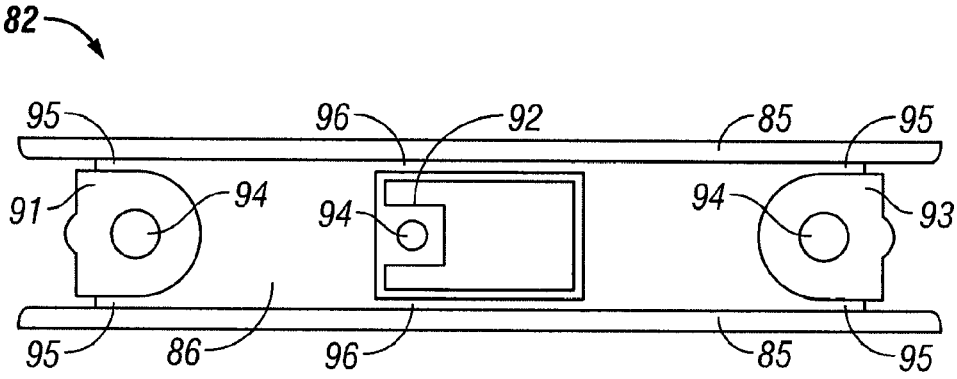
FIG. 17 is a top plan view of the insert of FIG. 15.

Extending upwardly from the upper surface of grinding portion 86 are three spaced blocks or brackets 91, 92, and 93 each having an upper portion with a fastener opening 94 for receiving the shaft of a frame bolt when the grinding insert and frame member are secured to the sole 13 of a skate boot. Openings 94 are positioned for alignment with the corresponding front, center and rear openings 24 of the frame member 15 when the parts are assembled as in FIG. 19. As illustrated in FIGS. 17 and 18, each fastener block or bracket has opposite sides spaced from the respective side wall 85 of the insert to provide spaced front and rear channel sections or grooves 95 and central channel sections or grooves 96. Grooves 95, 96 are used for seating the insert over the recessed portions 18 of the opposite side walls of the frame.

FIG. 20 illustrates the modified grinding insert 82 positioned for seating engagement in the recessed portions 18 of the frame side walls 20. As in the previous embodiment, the upper edges 98 and end edges 99 are shaped to match the corresponding upper edge 60 and end edges 62 of recessed portions 18. The insert 82 is positioned with its upper end facing the lower end of the frame member 15 and with the side walls 85 in alignment with the side walls 20 of the frame. It is then moved over the recessed portions 18 of the side walls in the direction of the arrows in FIG. 20, until the grooves 95, 96 engage over the recessed portions in the same manner as illustrated in FIG. 13 in connection with the previous embodiment. FIGS. 19 and 20 illustrate the grinding insert fully seated in the recessed portions 18 of the frame side walls. When seated, the fastener openings 24 are aligned with the fastener openings 94 at the upper side of the grinding insert, and both the frame member and grinding insert can be secured together to the sole of a skate boot or shoe with frame bolts extending through the aligned openings 24 and 94 and aligned openings in the sole 13 of the boot, in the same way as in FIG. 14.

Although the frame assembly in the above embodiment has a frame member separate from the sole of a boot, in alternative embodiments the frame may be formed integrally with the sole of the boot. In this case, the spaced openings in the insert are aligned with openings in the sole of the boot and the insert is secured to the frame by bolts extending through the aligned openings.

Various different H-block or grinding inserts of different materials or with different shaped grinding surfaces, or both, may be provided for selective attachment in the frame assembly of the above embodiments. When a grinding insert becomes worn, or a different type of grinding insert is desired for performing more or less acrobatic maneuvers, for example, the current grinding insert can be readily removed from the assembly simply by releasing the three frame bolts, and a new grinding insert can then be installed using the same frame bolts. All sliding or grinding surfaces are provided on the H-block or grinding insert, so that sliding on frame surfaces is normally avoided.

In each of the above embodiments, the H-block or grinding insert has a stable tongue and groove engagement with a recessed portion of each frame side wall, and has outer surfaces which are substantially flush with the adjacent outer surface portions of the frame side wall. This arrangement reduces wear on the frame surfaces, provides a grind surface which is relatively easy to replace, and provides a relatively strong attachment between the grinding insert, frame, and skate boot, so that the frame may be less likely to crack or be damaged on jump landings and the like. The grinding insert is much longer than prior art H-blocks which were typically attached in a small recess at the center of the frame, and has opposite ends positioned close to the front and rear wheel axle openings in the frame, with the side walls of the grinding insert slightly overlapping the front and rear wheels when mounted in the frame assembly as illustrated in FIG. 1.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An in-line skate frame assembly, comprising:

a rigid frame for attachment to the sole of a shoe or boot, the frame having an upper portion, a pair of spaced side walls extending downwardly from the upper portion, and opposite ends, each side wall having a recessed region;

the side walls of the frame having at least two first and second pairs of aligned wheel axle openings which receive wheel axles of first and second in-line skate wheels between the side walls;

the upper portion of the frame having at least two spaced fastener openings; and an elongate H-block grinding insert separate from the frame which engages over the recessed region of each side wall and extends between the frame side walls, the grinding insert having a length greater than half the length of the frame and being centrally located along the length of the frame with opposite ends of the grinding insert terminating short of the respective opposite ends of the frame;

the insert having spaced side walls, a lower, arcuate grinding portion extending between the side walls along at least part of their length, and an upper portion between the side walls which has at least two openings aligned with the respective fastener openings in the upper portion of the frame;

the aligned fastener openings in the frame and grinding insert configured to receive fasteners which secure the insert and frame together to an in-line skate shoe or boot;

the side walls of the insert have a third pair of aligned wheel axle openings on one side of the grinding portion and a fourth pair of aligned wheel axle openings on the opposite side of the grinding portion, the third and fourth pairs of wheel axle openings receiving the wheel axles of third and fourth in-line skate wheels, respectively.

2. The assembly of claim 1, wherein the upper portion of the frame has first, second, and third spaced fastener openings, and the upper portion of the insert has corresponding first, second and third spaced fastener openings which are aligned with the frame fastener openings and configured to receive fasteners securing the frame and insert to a skate shoe or boot.

3. The assembly of claim 1, wherein the grinding portion has a downwardly facing, arcuate grinding surface.

4. The assembly of claim 1, wherein the grinding portion has a downwardly facing, elongate, grinding surface of generally V-shaped longitudinal cross-section.

5. The assembly of claim 1, wherein the upper portion of the frame has spaced connecting portions extending between the side walls, and open spaces between adjacent connecting portions, the fastener openings being located in the connecting portions.

6. The assembly of claim 1, wherein the grinding insert comprises a single block centrally located in the frame which extends along a major portion of the length of the frame including the central portion of the frame and terminates short of the opposite ends of the frame.

7. The assembly of claim 5, wherein the upper portion of the insert has spaced connecting portions positioned between the side walls, the insert fastener openings being located in the connecting portions.

8. An in-line skate frame assembly, comprising:

a rigid frame for attachment to the sole of a shoe or boot, the frame having an upper portion, a pair of spaced side walls extending downwardly from the upper portion, and opposite ends, each side wall having a recessed region;

the side walls of the frame having at least two first and second pairs of aligned wheel axle openings which receive wheel axles of first and second in-line skate wheels between the side walls;

the upper portion of the frame having at least two spaced fastener openings; and an elongate H-block grinding insert separate from the frame which engages over the recessed region of each side wall and extends between the frame side walls, the grinding insert having a length greater than half the length of the frame and being centrally located along the length of the frame with opposite ends of the grinding insert terminating short of the respective opposite ends of the frame;

the insert having spaced side walls, a lower, arcuate grinding portion extending between the side walls along at least part of their length, and an upper portion between the side walls which has at least two openings aligned with the respective fastener openings in the upper portion of the frame;

the aligned fastener openings in the frame and grinding insert configured to receive fasteners which secure the insert and frame together to an in-line skate shoe or boot;

the recessed region comprises an outwardly facing, indented portion of each frame side wall and at least part of each of the side walls of the insert engage in the indented portions of the respective frame side walls;

each side wall of the insert has an upwardly facing channel extending along part of the length of the insert which engages over the indented portion of the respective frame side wall.

9. The assembly of claim 8, wherein the insert side walls each have an outer surface substantially flush with surrounding outer surface portions of the frame when the insert is secured in the frame.

10. The assembly of claim 8, wherein the indented portion and the insert side walls each have an upper edge and opposite end edges, the upper edge and opposite end edges of the indented portion of each frame side wall substantially matching the shape of the upper edge and opposite end edges of the insert side walls.

11. The assembly of claim 8, wherein the indented portion has a substantially arcuate, concave lower edge.

12. The assembly of claim 8, wherein each side wall has a plurality of spaced, upwardly facing channels which engage over the indented portion of the respective frame side wall.

13. The assembly of claim 8, wherein the grinding portion is centrally located along the length of the insert and the frame and has opposite ends spaced from the wheel axle openings.

14. The assembly of claim 13, wherein the grinding portion extends for less than half the length of the insert.

15. The assembly of claim 13, wherein the grinding portion extends along the majority of the length of the insert.

16. An in-line skate frame assembly, comprising:

a rigid frame for attachment to the sole of a shoe or boot, the frame having an upper portion, a pair of spaced side walls extending downwardly from the upper portion, and opposite ends, each side wall having a recessed region, the upper portion of the frame having at least two spaced fastener openings;

the side walls of the frame having at least two pairs of aligned wheel axle openings which receive wheel axles of first and second in-line skate wheels between the side walls;

an elongate H-block grinding insert which engages in the recessed region of each side wall and extends between the frame side walls, the grinding insert having a length greater than half the length of the frame;

the insert having spaced side walls, a lower, arcuate grinding portion extending between the side walls along at least part of their length, and an upper portion between the side walls which has at least two openings aligned with the respective fastener openings in the upper portion of the frame;

the aligned fastener openings in the frame and grinding insert receiving fasteners which secure the insert and frame together to an in-line skate shoe or boot;

the upper portion of the frame having spaced connecting portions extending between the side walls, and open spaces between adjacent connecting portions, the fastener openings being located in the connecting portions;

the upper portion of the insert having spaced connecting portions positioned between the side walls, the insert fastener openings being located in the connecting portions; and the side walls of the insert having lower edges and the connecting portions comprising front and rear connecting portions having opposite sides connected to the lower edges of the insert side walls, the sides of the connecting portions each being spaced inwardly from the respective insert side wall to form front and rear channels which engage over the recessed portion of the respective frame side wall.

17. The assembly of claim 16, wherein the insert has a central connecting portion projecting upwardly from the grinding portion, the central connecting portion having opposite sides spaced inwardly from the respective insert side walls to form a central channel which engages over the recessed portion of the respective frame side wall.

18. An in-line roller skate, comprising:

a boot having a sole which has at least one fastener opening;

a rigid frame having an upper portion and two spaced side walls extending downwardly from opposite sides of the upper portion, the upper portion of the frame having at least one fastener opening positioned for alignment with the fastener opening in the sole of the boot;

each side wall having a recessed region of predetermined shape extending along a major portion of the length of the frame;

at least a front wheel and a rear wheel rotatably secured between the side walls adjacent the front and rear end of the frame;

an elongate grinding insert having an upper portion and spaced side walls extending downwardly from the upper portion, the insert engaging in the recessed region of the frame side walls with the upper portion of the insert located beneath the upper portion of the frame, the upper portion of the insert having at least one fastener opening aligned with the fastener openings in the sole of the boot and upper portion of the frame;

at least one fastener extending through the aligned fastener openings in the sole of the boot and the upper portions of the frame and grinding insert, and releasably securing the upper portions of the frame and grinding insert together to the sole of the boot; and the recessed region of each side wall comprises a wall portion of reduced thickness having an inner surface and an indented outer surface portion spaced inwardly from the outer surface of the remainder of the respective side wall, and the side walls of the insert are engaged over the indented outer surface portion.

19. The skate of claim 18, wherein the at least one fastener comprises a frame bolt.

20. The skate of claim 18, comprising three spaced fasteners releasably securing the upper portions of the frame and grinding insert together to the sole of the boot.

21. The skate of claim 18, wherein the insert has upwardly facing channels extending along at least part of the length of the insert which engage over the inner surface and outer surface portion of the recessed regions of the respective frame side walls.

22. The skate of claim 18, wherein each side wall has a lower edge which has a concave portion extending along at least part of said recessed region, the grinding insert has a central, downwardly facing grinding surface which extends over at least part of the length of the concave portion of the lower edges of the respective frame side walls, the grinding surface having opposite ends spaced from the opposite ends of the insert side walls.

23. The skate of claim 18, wherein the insert is a one-piece member.

24. The skate of claim 22, wherein third and fourth wheels are rotatably secured between the spaced side walls of the insert, the third wheel being located in a space between the grinding surface and the front wheel, and the fourth wheel being located in a space between the grinding surface and rear wheel.

25. The skate of claim 22, wherein the grinding surface extends over a major portion of the length of the insert and has opposite ends adjacent the front and rear wheels.

26. The skate of claim 25, wherein the grinding surface is generally V-shaped in longitudinal cross-section and has an apex and end portions which taper downwardly from the apex towards the opposite ends of the grinding surface.

27. An in-line skate frame assembly, comprising:

a rigid frame for attachment to the sole of a shoe or boot, the frame being of generally inverted U-shaped cross-section along at least part of its length and having a pair of spaced side walls each having a lower edge and opposite inner and outer faces, and an upper portion extending between the side walls;

the side walls of the frame having at least two pairs of aligned wheel axle openings which receive wheel axles of first and second in-line skate wheels between the side walls;

an elongate H-block grinding insert separate from the frame which is secured between the frame side walls, the grinding insert having a length greater than half the length of the frame and being centrally located along the length of the frame with opposite ends of the grinding insert terminating short of the opposite ends of the frame; and the insert having spaced side walls which extend upwardly over at least part of the outer faces of the respective frame side walls, a lower, arcuate grinding portion extending along at least part of the length of the insert side walls, the grinding portion extending between the side walls of the insert and over the lower edges of the frame side walls, and an upper portion between the side walls which is located beneath the upper portion of the frame.

28. The assembly of claim 27, wherein the upper portion of the frame and upper portion of the insert have aligned fastener openings extending upwardly in a direction transverse to the wheel axle openings and at least one fastener extends through the aligned fastener openings and is configured to secure the frame and insert together to an in-line skate or boot.

29. The assembly of claim 27, wherein each side wall of the insert has an upwardly facing channel forming spaced inner and outer wall portions, each channel being engaged over a respective frame side wall with the inner portion extending over at least part of the inner face of the respective frame side wall and the outer portion extending over at least part of the outer face of the respective frame side wall.

* * * * *